US007334682B2

(12) United States Patent
Goepfert

(10) Patent No.: US 7,334,682 B2
(45) Date of Patent: Feb. 26, 2008

(54) PACK WITH OVERLAPPING DISPENSING ORIFICE CREATED BY LAMINATED PACKAGING MATERIAL

(75) Inventor: Sandra Goepfert, Speyer (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/967,792

(22) Filed: Oct. 18, 2004

(65) Prior Publication Data

US 2005/0109652 A1 May 26, 2005

(30) Foreign Application Priority Data

Nov. 26, 2003 (EP) ..... 03027105

(51) Int. Cl.
*B65D 65/28* (2006.01)
*B65D 27/34* (2006.01)

(52) U.S. Cl. ..... 206/494; 383/66; 383/203; 383/207

(58) Field of Classification Search ..... 206/494, 206/440, 438; 383/66, 203, 205, 207, 200
See application file for complete search history.

(56) References Cited

U.S. PATENT DOCUMENTS 2,750,096 A * 6/1956 Misch ..... 229/213
3,002,674 A * 10/1961 Wright ..... 383/200
3,807,626 A 4/1974 Goodrich
5,065,868 A * 11/1991 Cornelissen et al. ..... 206/494
5,531,325 A * 7/1996 Deflander et al. ..... 206/494
6,328,472 B1 12/2001 Laurence et al.

FOREIGN PATENT DOCUMENTS

| | | |
|---|---|---|
| DE | 31 00 286 A1 | 4/1982 |
| DE | 39 11 779 A1 | 5/1991 |
| DE | 39 20 065 A1 | 6/1992 |
| DE | 3542999 A1 | 8/1996 |
| DE | 199 50 687 | 4/2001 |
| EP | 0 475 463 B1 | 4/1990 |
| EP | 0 401 621 B1 | 8/1991 |
| EP | 0 553 660 B1 | 10/1994 |
| EP | 0 961 736 B1 | 11/2001 |
| EP | 1 318 081 | 6/2003 |
| EP | 1 120 356 B1 | 8/2003 |
| EP | 1466 843 A1 | 10/2004 |
| EP | 1 535 857 A1 | 5/2005 |
| WO | WO 98/06369 | 2/1998 |

* cited by examiner

*Primary Examiner*—Mickey Yu
*Assistant Examiner*—Jerrold Johnson
(74) *Attorney, Agent, or Firm*—Peter D Meyer; David M. Weirich; Betty J. Zea

(57) ABSTRACT

A pack for products that can be dispensed from the pack, such as a pack for paper handkerchiefs and a method of making such a pack. The pack includes a flexible film material wherein the body of the pack has a first thickness and overlapping portions of film material providing the orifice have second and third thicknesses. The second and third thicknesses are each less than the first thickness.

5 Claims, 3 Drawing Sheets

(A-A')

PACK WITH OVERLAPPING DISPENSING ORIFICE CREATED BY LAMINATED PACKAGING MATERIAL

FIELD OF INVENTION

The invention relates to a pack for products that can be dispensed from the pack, such as a pack of paper handkerchiefs. The invention describes a pack that provides hygienic protection of the products in the pack while allowing for an easy, convenient dispensing of the products and optimizing the use of materials.

BACKGROUND OF THE INVENTION

Many products are sold in flexible packaging from which the products are dispensed. Such products can be paper products or wipes of all sorts. The packs act as protective barrier to prevent dust and dirt from coming in contact with the products during storage and use. The packs are also in many cases the preferred dispensing device from which the users can remove the product prior to use. In most cases, the dispensing is done through an orifice in the pack adapted to let the products (such as paper handkerchiefs) be removed from the pack while still confining the remaining products inside the pack and still allowing for good storage and protection of the unused products. Packs of the present invention have a dispensing orifice which includes an overlapping portion: the overlap creates an efficient barrier to dust and dirt while allowing for a convenient use of the pack.

Packs made of flexible film materials are usually made by cutting and folding the film material in such a way that the end configuration corresponds to the shape of the desired pack. Conventionally, the overlapping portion (i.e. a flap) of the pack is added to the pack as a separate piece of material. Not only does this cause a significant complexity in the manufacturing process, but it also increases the total pack cost because of the extra material in the overlapping portion.

There is a need to provide packs having an orifice, fully enabling the convenience of dispensing of handkerchiefs. There is need for a pack offering an enhanced level of protection for the product inside the pack, via an overlapping dispensing orifice, while being relatively simple to manufacture. There is a need for a pack comprising flexible film materials having a overlapping portions with improved material utilization. There a need for such a pack that is also designed and manufactured in a way that reduces production, capital and material cost. There is a need for such a pack that is relatively easy to manufacture. There is a need for such a pack that does not have a double layer of material in the overlapping area of the dispensing orifice. Finally there is a need for such a pack that combines many or all of the above advantages.

SUMMARY OF THE INVENTION

The present invention describes a pack usable for packing articles. The pack includes a body portion comprised of a first portion of a flexible film and a second portion of the flexible film. The first portion of the flexible film has a first thickness and the second portion has a second thickness. The pack also has a flap comprised of a third portion of the flexible film having a third thickness. The third portion overlaps at least a portion of the second portion and is releasably joined thereto to form a dispensing orifice for removing an article from the pack. The dispensing orifice allows for removal of an article from the pack when the third portion is separated from the second portion. The second thickness and the third thickness are each less than the first thickness.

The present invention is also directed to a method for making a pack.

DETAILED DESCRIPTION OF THE INVENTION

Figure 1:
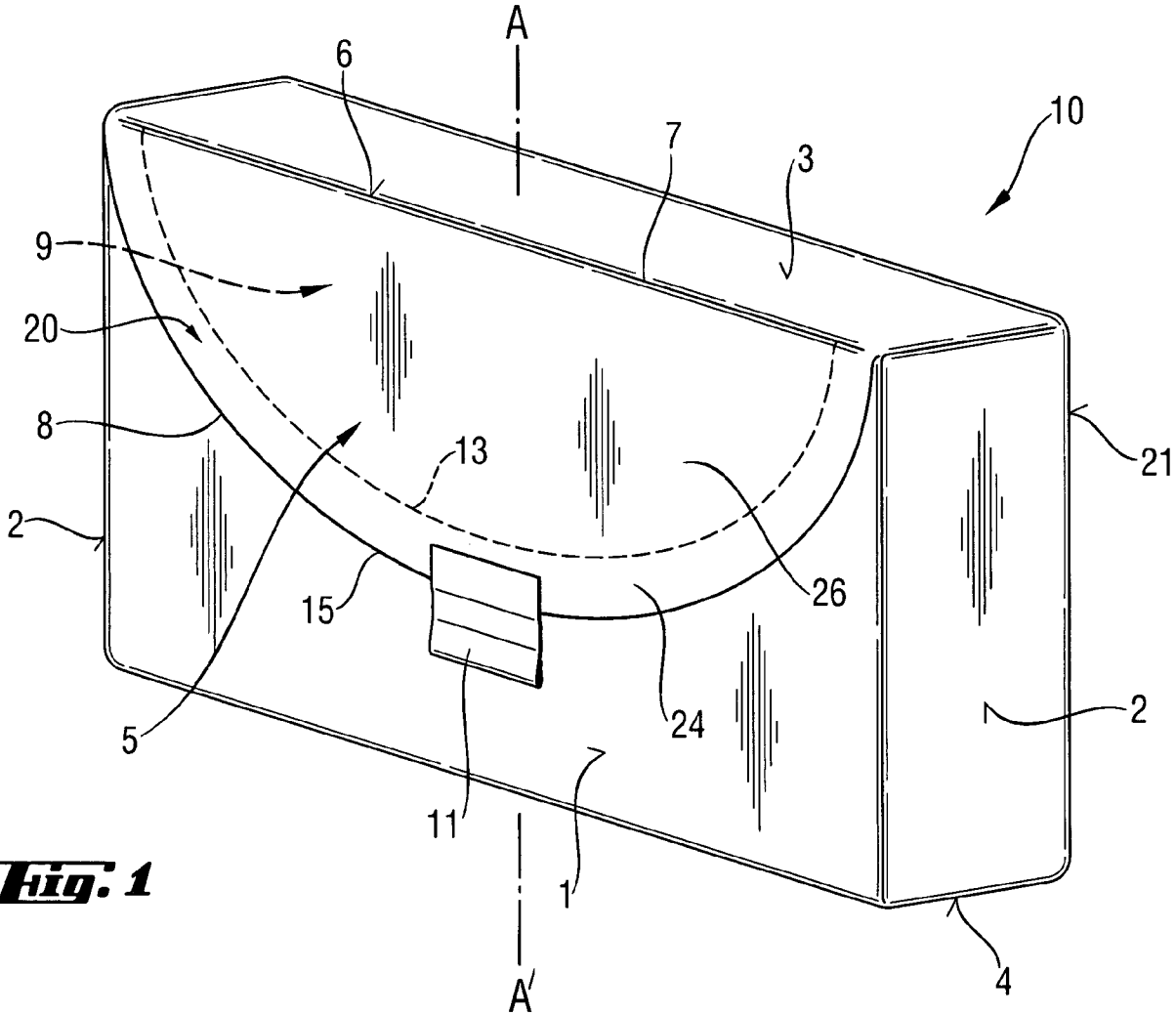
FIG. 1 is an isometric view of one example of the pack of the present invention (a pack of paper handkerchiefs).

As shown in FIG. 1, pack 10 has front panel 1 defined as the panel of largest area. The pack 10 exemplified in FIG. 1 also has back panel 21. For simplicity in this document, the reference to "the" front panel of the pack indicates the one panel comprising the dispensing orifice or part of it.

The side panels are labeled 2, the top panel 3 and bottom panel 4. The dispensing orifice 9 is the aperture though which the products (e.g. the tissue in the case of a pack of paper handkerchiefs) can be grabbed and possibly removed from the pack 10 during the dispensing operation. The flap or closure means 5 is a piece of material movable between a closed and an open position, and able to cover at least partially the dispensing orifice 9. The flap 5 may articulate around hinge 6. The periphery of the closure means 5 then has a connected portion 7 (articulating around a hinge 6) and an unconnected portion 8. The unconnected portion 8 is not permanently attached to the pack 10. In the present invention, the flap 5 not only covers the dispensing orifice 9 but its overlapping area 20 overlaps a portion of material forming one panel, preferably the front panel 1. The reseal tape, or reseal piece 11 is a piece of material able to maintain the flap in the closed position and generally allows the pack 10 to be re-opened as needed to enable dispensing of the articles in the pack 10.

For the purpose of the present invention, the following terms and wording are defined and used interchangeably, and with the same meaning:

Products or articles such as handkerchiefs, paper handkerchiefs, towels or tissues.

"Film", "flexible film", "wrapping material", "packing material" describe the flexible material constituting the majority of the pack. The flexible film used in the present invention can be any type of film suitable for the making of packs and combining a flexibility and resistance. In certain embodiments, the film may be a heat sealable film comprising polyethylene or polypropylene or mixture thereof.

A "pack" or "container" is a receptacle for products usually intended to protect and keep the products together during storage and use.

"Dispensing orifice", "orifice" or "dispensing aperture" refer to an opening through which the individual product (for examples paper handkerchiefs) may be removed from the pack.

"Dispensing flap", or "flap" or "closure means" describe the piece of material covering at least partially the dispensing orifice. The terms also describe a part of the packing material intended to cover part of another portion of packaging material in the final configuration of the pack.

An "overlap" or "overhang" or "overlapping portion" of film material refers to an overlapping portion is defined as a portion of film material that, in the intended final configuration of the pack and in normal usage conditions, can overlap another portion of film material of the pack (for reciprocity reason, that other portion of material being overlapped is also defined as being an overlapping portion, as both portions mutually overlap each other). In one embodiment of the present invention, one overlapping portion is located on the flap covering the dispensing orifice. Upon closure of the flap against the front panel, the overlap can cover a part of the front panel (to insure high protection of the products inside the pack).

A "non-overlapping portion" of film material is defined as a portion of film material of the pack that, in the intended final configuration of the pack and under normal usage conditions, is not intended to overlap with another portion of material. It is however understood that the film material of the invention is typically a flexible film. Therefore, any portion of the pack could be considered as able to overlap another portion, when the pack is crushed, flattened, folded or squeezed. The above definitions specifically exclude those cases as they are not "normal usage conditions" and that a pack crushed, squeezed, flattened or folded pack is not in its intended final configuration.

The "thickness" of a film material or the "caliper" of a film material is measured according to the method provided hereafter. It is understood that the thickness of a layer is the average thickness of that material measured in areas where the material is homogeneous and of substantially constant thickness (it is assumed that common film materials, as those used for the purpose of this invention, are usually provided as raw materials of substantially constant thickness).

In the context of packs of product such as paper handkerchiefs, etc., one can understand easily that a large flap 5 covering all the dispensing orifice 9 and extending over it to create an overlap on one of the panels is extremely beneficial for the protection of the products inside the pack. However, such a large overlap may require additional and significant material cost. It may also present the technical difficulty of requiring a particular process and/or a secondary material providing for the flap 5 or overlap. The simple fact of having an overlapping portion of film material diminishes the optimum utilization of the film as the overlap represents a zone having double amount of film material. Furthermore, the thickness of the extra material can cause some issues in certain types of packaging.

In the present invention, the pack 10 includes at least two layers of material that are generally joined together in a face-to-face relationship to substantially constitute the body of the pack 10.

The slits, cuts, perforations 13 or other means defining the dispensing orifice 9 of the pack 10 are positioned on each layer in such a way that they do not overlap when the layers are juxtaposed and joined together.

The portions of film material located between the slits 13 are not joined together, thus enabling the flap 5 to separate from the panel when the pack 10 in its final folded configuration. This construction creates an overlapping zone surrounding the dispensing orifice(s) 9 ensuring good protection of the packed products.

FIG. 1 exhibits a particular example of the pack of the present invention. The pack 10 comprises panels 1, 2, 3, 4, 21 (i.e. front panel 1, side panels 2, bottom panel 4 and back panel 21) and a dispensing orifice 9. The pack 10 is made of a flexible film material. The body of the pack 10 is made of at least two layers of film material joined together (to note, the joined layers of flexible film material, considered as a whole, represent as well a flexible film packing material). A flap 5, hingily connected to the body of the pack 10, covers the dispensing orifice 9 and overlaps a portion of the film material forming the front panel 1 (thus ensuring an increased protection of the products).

It is to be noted that each single layer of flexible film material usable as per the present invention can be comparatively of lower caliper (or/and lower basis weigh) in comparison to conventional packs. As a (at least) double layer of material is used to form the body of the pack 10, the film material protecting the products is altogether as thick and as resistant as in conventional packs.

Figure 2:
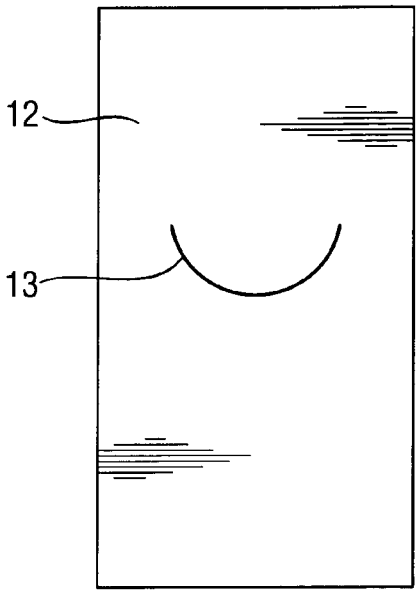
FIG. 2 shows a first layer of film material used to construct one embodiment of the pack.

In FIG. 2, a first piece of relatively thin packaging film material 12 is shown. It constitutes the first layer of film material in the construction of the pack 10. The film material 12 is cut in a substantially rectangular shape. That shape corresponds to the material used to form the substantially parallelipedic pack 10 of FIG. 1. The material is severed by a first slit 13 in the material corresponding to the general shape of the closure means 5 shown in FIG. 1. The slit 13 will delineate the edge of the dispensing orifice 9 in the formed pack 10.

Figure 3:
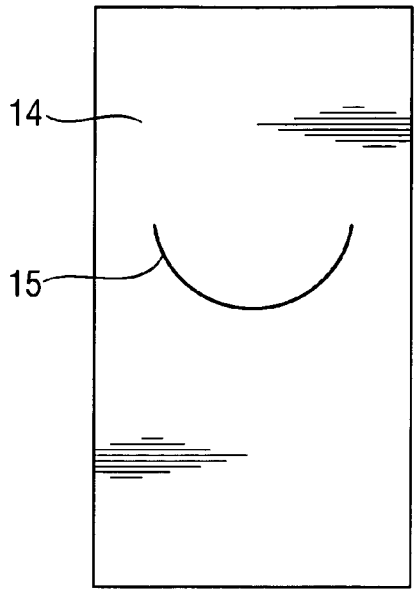
FIG. 3 shows a second layer of film material used to construct one embodiment of the pack.

Similarly, in FIG. 3 is shown a second piece of film material 14. It constitutes the second layer of film material in the construction of the pack 10. As for the first layer, a second slit 15 is provided in the second piece of film material 14. The second slit 15 on the second piece of film material 14 may have a shape substantially similar to the shape of the first slit 13 on the first piece of film material 12. In other embodiments however, the slits 15 can have substantially different shapes. As noted above, the position of the slits 13, 15 (relative to the pieces of material) is different in the first 12 and second 14 pieces of film material.

The material of the first and second pieces 12, 14 of flexible film material can be identical material or their composition can differ. Preferably, their composition, thickness and characteristics are adapted to deliver the intended characteristics (resistance, color, softness, etc) to the body of the pack 10.

An advantage of the present invention is that the film material can be substantially thinner (and/or of lower basis weight) than the film material used in conventional pack making. This is enabled by the use of a double layer of material to constitute the final pack walls (i.e. the first and second pieces of film material joined together). In one embodiment, the film material used in the present invention has a basis weight of less than about 30 g/sqm, less than about 25 g/sqm or less than about 20 g/sqm.

The film material 12, 14 may be printed with decorative or other visual indicia, such as logos, pictures or text, etc.

Figure 4:
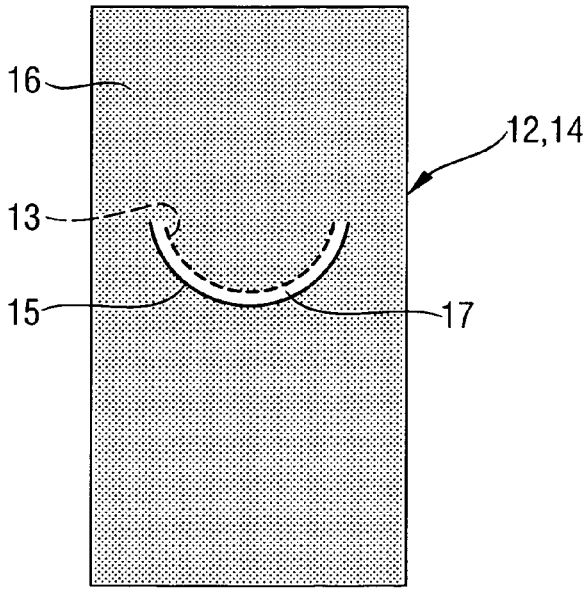
FIG. 4 shows the pack material resulting from the lamination of the first and second layers of film material shown in FIGS. 2 and 3.

FIG. 4 shows the pieces of film material 12, 14 of FIGS. 3 and 4 superimposed to form the total material that make the body of the pack 10. That film (composed of the first 12 and second 14 pieces of film material superimposed) will be folded, further severed, and joined to adopt the three-dimensional configuration of the pack 10. In this embodiment, the first slit 13 of the first layer and the second slit 15 of the second material are not superimposed nor do they cross over each other.

The pieces of film material 12, 14 are joined together on most of their surface, except in the area between the slits 13 and 15. Reference 16 indicates the area in which the two layers are joined together. Reference 17 indicates the area in which the two layers are not joined together but only superimposed. This area 17 becomes the overlapping area 20 in the folded pack 10.

The two layers 12 and 14 can be joined together by any means capable of attaching the layers. For example, gluing, thermal bonding, lamination under high pressure or any combination thereof may be used.

Figure 5:
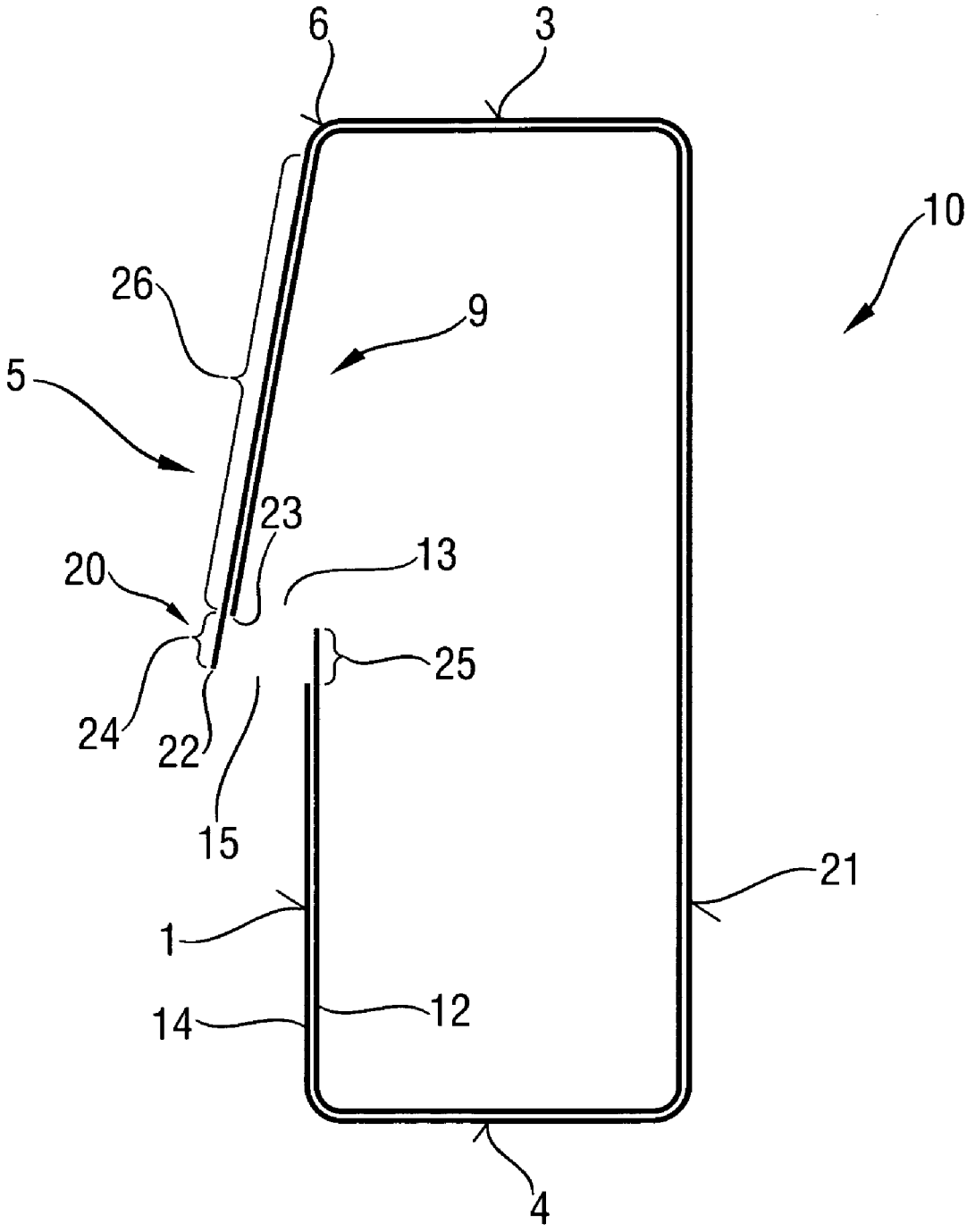
FIG. 5 represents a isometric view of a pack, showing the arrangement of the laminated two layers of film material.

FIG. 5 represent a cross section on the pack 10 (indicated A-A' on FIG. 1). In the illustration, in order to enhance the understanding, the two layers 12 and 14 of film material are shown as separate entities, whereas the layers 12 and 14 are preferably joined in such a way that they substantially constitute a single piece of film material once joined together, and they do not separate in use.

The edges of the dispensing orifice 9 and of the overlapping flap 5 comprise the edge 23 of the first layer (made from the slit 13 in the first layer of film material 12), and the edge 22 of the second layer 14 (made from the second slit 15 in the second layer 14).

The overlap 20 is defined by the portion of material of the first layer 12 and second layer 14 that are located between the slits 13 and 15. The first overlapping portion 25 of the first layer of material 12 overlaps with the second overlapping portion 24 of the second layer of material 14.

The thickness of the non-overlapping portions of material is called the first thickness. In one embodiment, the first thickness is the general thickness of the walls or panels of the pack (except in the overlapping portions). In one embodiment, the total thickness of the pack panels is substantially the thickness of the two layers 12 and 14 of material joined together.

In one embodiment of the invention, the overlapping portions of material (24 and 25 in the zone 20) are comprised of one of the layers only. The thickness of the overlapping portions is substantially the thickness of their corresponding single layer of film material. The overlapping portions make up the so-called second and third thickness. The second and third thicknesses can be equal (for example when the same film material is used for the first 12 and second layers 14), or can be different.

In certain embodiments of the invention, one or more layers of film material used in the construction of the pack 10 can be made of the same material (i.e. be identical). In other embodiments, the first layer 12 or second 14 layer can be different and/or have same or different thicknesses in comparison to the second or third thickness.

A method to measure to measure the thickness of the film packaging material is provided herein. Any industry standard method is however adequate, provided that the measurements of the overlapping portions and non-overlapping portions of material are made according to the same method.

By construction, the thickness of each overlapping portion of material 24, 25 (so-called second and third thickness) is less than the thickness of the portion of non-overlapping film. In the embodiment illustrated in a simplified way in FIG. 5, the thickness of the overlapping portion of film is about half the thickness of non-overlapping portions of film. The overlapping portions 24 and 25 include only one layer of film whereas the non-overlapping portion 26 includes at least two layers of film.

The total thickness of the overlapping portions 24, 25 of the film material together (sum of the second and third thickness) can be less than about 1.8 time the thickness of the non-overlapping portion (first thickness), less than about 1.5 times the thickness of the non-overlapping portion, or less than about 1.2 times the thickness of the non-overlapping portion.

As the total thickness of the overlapping portions 24, 25 of material (in the area of the flap) is less than the first thickness (general thickness of the walls or panels of the pack), it is easily understood that the efficiency of material utilization can be increased. In the area where the overlapping portions 24, 25 overlap, generally no portion of film has a thickness more than the thickness of the panels of the pack. This helps to reduce the cost of material per pack. Additionally better closure, handling and functionality of the flap 5 can be attained by providing the overlapping configuration shown in the figures and described herein.

Process of Making the Pack of the Presenting Invention:

The present invention also includes a process for making the pack 10 of the present invention. The process of the present invention includes the steps of severing pieces of film packing material by cutting slits and joining the pieces of material in a face to face relationship such that the slits 13, 15 of each piece of material are not superimposed with each other. Generally, there is no part of any slit superimposed with any part of any other slit. The combined layers of material are then folded, further severed and joined together to form the intended final configuration of the pack 10. The slits 13, 15 are made in such a way that they define and delineate the dispensing orifice 9 of the pack 10 when the pack 10 is formed.

One of the process steps joins of the layers of film material together. The joining can be done by any means providing adequate attachment of the layers together (for example gluing, thermal bonding, lamination under pressure, application of binders, etc.). However, the area between the slits 13, 15 is generally not joined together (beside the presence of the re-seal tape). That area thus forms the overlapping portions of the pack.

The area of non-attachment 17 is the area located between the slits 13, 15 when the two layers of film material are superimposed. The area of non-attachment 17 is delimited by virtual lines extending from the end points of one slit to the corresponding end points of the other slit. However, one can foresee that the area not attached may be adapted to match the intended design and additional functionalities. This can allow designing the flap 5 with a specific form and shape of the overlapping area. For example, non-attached areas extending around the slits 13, 15 (and not only between the slits) can create more flexibility in the pack 10 and allow for optimum dispensing.

The area of non-attachment 17 can be created by a discontinuity in the joining process, a selection of the joining area, a masking of the area during the joining process to prevent them to be affected by the joining process or by any other adequate means.

In one embodiment of the present invention, the slits 13 and 15 are substantially parallel. The slits 13 and 15 may be substantially identical shape and the distance between them (when the layers are superimposed) may be substantially a constant (the distance along a tangential direction of one slit). For the purpose of the present invention, it is understood that the term "substantially parallel" includes but is not limited to the parallelism of each portion of the slits 13, 15, e.g. portion of curved line or portion of straight line. The approximated parallelism of the general directions of the slits 13, 15 and the correspondence of their shape is also included.

In other embodiments the slits 13, 15 are curved and do not comprise any straight portions. In yet other embodiments the slits 13, 15 on the first and second layers are non-parallel but their shape is adapted to form a functional aperture in the three-dimensional configuration of the formed pack.

It is easily understood that one of the advantages of process of the present invention is to avoid cutting out pieces of materials that need to be removed from the manufacturing lines (i.e. only slits are provided in the layers). This can increase both the efficiency of the manufacturing process and reduce the material cost.

Example of TEMPO® Tissue Packs:

It has been found that a pack of tissues such as paper handkerchiefs can be made according to this invention. One suitable film material is available from Bischof+Klein GmbH, (Bischof+Klein GmbH & Co. Rahestraβe 47 49525 Lengerich—Germany) and is made of 100% polyethylene having a thickness of about 18 micrometers. Two pieces of film material (previously printed to the desired graphical design) are cut into the desired shape to provide each one layer of film for making the pack. The pieces of film material are joined together by applying (via conventional glue printing) a thin layer of glue (for example, glue type 2k-LF570/Härter 130 available from Herberts GmbH, 42271 Wuppertal Germany) on the first and the second pieces of material and immediately laminating the two pieces together under sufficient pressure to insure a quasi-permanent bonding of the layers. The glue printing leaves on each layer one area free of glue (the glue-free area will form the overlapping portion of the pack material). Once laminated together, the layers are submitted to a standard process for forming a flexible pack from a flexible film. The material is folded, sealed, and further cut following the procedures known in the art. Similarly, additional pieces of material (such as a reseal tape) may be added.

Methods:

Thickness of film (Caliper of film): The caliper (or thickness) of the films of the present invention is measured (unless otherwise indicated) according to the International standard method ISO-4593 (second edition Nov. 15, 1993) titled "Plastics-Films and Sheeting-Determination of Thickness by Mechanical Scanning".

Film basis weight: The basis weights (g/sqm) of the films of the present invention are measured (unless otherwise indicated) according to the International norm DIN-ISO 536, issue Jun. 15, 1976.

All documents cited herein are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pack usable for packing articles, the pack comprising:

a body portion formed from a plurality of panels, each of said panels being formed from a multi-layered flexible film wherein the intersection of two adjacent panels forms an edge therebetween and the intersection of three mutually adjacent panels forms a corner, said plurality of panels forming a cavity therebetween; and, a flap portion comprising a portion of said multi-layered flexible film hingedly attached at an edge of said body portion and forming a dispensing orifice for removing said articles from said pack, said flap portion being movable between a first closed position wherein said flap portion is in releasable engagement with said body portion and a second open position wherein said flap portion is movable relative to said body portion, said flap portion being formed by a first slit disposed in a layer of said flexible multi-layered film disposed distal from said cavity and a second slit disposed in a layer of said multi-layered flexible film disposed proximate said cavity and at a spaced apart distance from said first slit, said first slit beginning at a first terminus of said edge and ending at a second terminus of said edge, said second slit beginning and ending intermediate both said first and second terminus, said layer of said flexible multi-layered film disposed distal from said cavity and disposed between said first and second slits comprising a portion of said flap portion, said layer of said multi-layered flexible film disposed proximate said cavity and disposed between said first and second slits comprising a portion of said body portion such that said flap portion of said area between said first and second slits overlaps said body portion when said flap is in said first closed position.

2. The pack of claim 1 wherein said multi-layered flexible film comprises a first layer of flexible film joined together with a second layer of flexible film.

3. The pack of claim 2 wherein said area between said slits overlapping said body portion comprises only a single layer of said multi-layered flexible film.

4. The pack of claim 3 wherein said area between said slits overlapping said body portion comprises only said first layer of flexible film and said body portion overlapped by said area between said slits comprises said second layer of flexible film.

5. The pack of claim 1 wherein said multi-layered flexible film comprises two layers of flexible film materials partially joined together.

* * * * *